US005697040A

United States Patent [19]

Rabjohns et al.

[11] Patent Number: 5,697,040

[45] Date of Patent: Dec. 9, 1997

[54] PRINT JOB INTERMIXING WITHIN MARKING MACHINE

[75] Inventors: Douglas T. Rabjohns, Fairport; James S. Stoll, Wolcott, both of N.Y.

[73] Assignee: Xerox Corporation, Stamford, Conn.

[21] Appl. No.: 677,993

[22] Filed: Jul. 10, 1996

[51] Int. Cl.[6] ..... G03G 21/00

[52] U.S. Cl. ..... 399/382; 399/82

[58] Field of Search ..... 399/76, 77, 78, 399/82, 83, 10, 87, 382; 358/403; 355/77

[56] References Cited

U.S. PATENT DOCUMENTS 4,099,860 7/1978 Connin ..... 399/87

5,245,368 9/1993 Farrell et al. ..... 399/87

5,307,458 4/1994 Freiburg et al. ..... 395/162

5,377,016 12/1994 Kashiwagi et al. ..... 358/403

5,452,068 9/1995 Farrell ..... 355/321

*Primary Examiner*—Arthur T. Grimley
*Assistant Examiner*—Quana Grainger
*Attorney, Agent, or Firm*—Ronald F. Chapuran

[57] ABSTRACT

A method of arbitrarily interleaving the images of a second job with the images of a first job that is being completed at a first output station. A queue of jobs submitted to a marking machine for completion is scanned to determine if any of the queue of jobs can be interleaved with the first job during the first job production run. If so, one or more of the jobs in the queue are scheduled to be interleaved during the first job production run for completion at a second output station.

16 Claims, 9 Drawing Sheets

PRINT JOB INTERMIXING WITHIN MARKING MACHINE

BACKGROUND OF THE INVENTION

The invention relates to processing print jobs, and, in particular, to a system for intermixing the processing of a second job within the current processing of a first job.

In the prior art, there has been an evolution of incorporating finishing functions within print systems. In central reproduction environments there is a great amount of effort put into processing multiple, high volume jobs and finishing the documents, such as offsetting, stacking, binding, or stapling, that are printed with minimal loss of time. Also, with printers attached to a network, there are many individuals competing to have jobs completed and the lack of intelligent priority setting diminishes productivity. The prior art is replete with systems to increase the efficiency and productivity of marking engines.

For example, in U.S. Pat. No. 5,452,068, there is disclosed a method for producing prints in a printing machine. A marking engine is operatively coupled with a finishing device that normally experiences productivity loses in the marking engine. The method includes storing multiple print jobs and printing a first portion of a first print job. Then the printed first portion of the first print job is transmitted to the finishing device for performing a finishing operation on the printed first portion of the first print job. Concurrently, a selected portion of a second print job and a portion of a third print job are printed and transmitted to a print output area separate from the finishing device. Then, printing of a second portion of the first print job is initiated concurrent with performing a finishing operation on the first print job for reducing productivity loses in the marking engine.

In addition, U.S. Pat. No. 5,307,458 discloses the use of a video processor for processing a first set of image data concurrent with a memory and apparatus for transferring a second set of image data between the memory and an input/output device. U.S. Pat. No. 5,506,657 discloses a system for using resources such as printers, copiers and fax machines in an interleaved manner.

A difficulty with prior art systems such as described above is the need to skip pitches and delay timing to be able to intermix multiple jobs. There is also an inability to prioritize jobs ready to print and to be able to run and complete one or several small jobs during the processing of a very high volume job. Even if it is possible to intermix jobs in the prior art, prior art systems are operated according to set boundaries and are not capable of dynamically intermixing jobs not only according to job priority, but also being able to blend jobs into a job already in process at different rates of processing.

It would be desirable, therefore, to be able to look ahead at a job queue, find one or more suitable jobs in the queue(for example, jobs not requiring unavailable paper stock and jobs that can be delivered to a separate output device), and be able to concurrently run multiple jobs. It would also be desirable to be able to adjust the rate of concurrent processing of multiple jobs.

It is an object of the present invention, therefore, to be able to scan a job queue during the processing of a first job and while processing the first job, being able to intermix the concurrent processing of multiple jobs delivered to multiple output stations. It is still another object of the present invention to be able to dynamically adjust the ratio of processing of intermixed jobs based on the priority of the jobs.

Other advantages of the present invention will become apparent as the following description proceeds, and the features characterizing the invention will be pointed out with particularity in the claims annexed to and forming a part of this specification

SUMMARY OF THE INVENTION

A method of blending the images of a second job with the images of a first job during the first job processing by scanning a queue of jobs submitted to a marking machine for completion. If any of the jobs in the queue can be interleaved during the first job production run, a priority of completion is determined. A job or multiple jobs from the queue are then scheduled for completion depending upon the priority. The jobs from the queue can be arbitrarily interleaved with the first job in any suitable manner to maintain productivity.

For a better understanding of the present invention, reference may be had to the accompanying drawings wherein the same reference numerals have been applied to like parts.

DESCRIPTION OF THE INVENTION

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
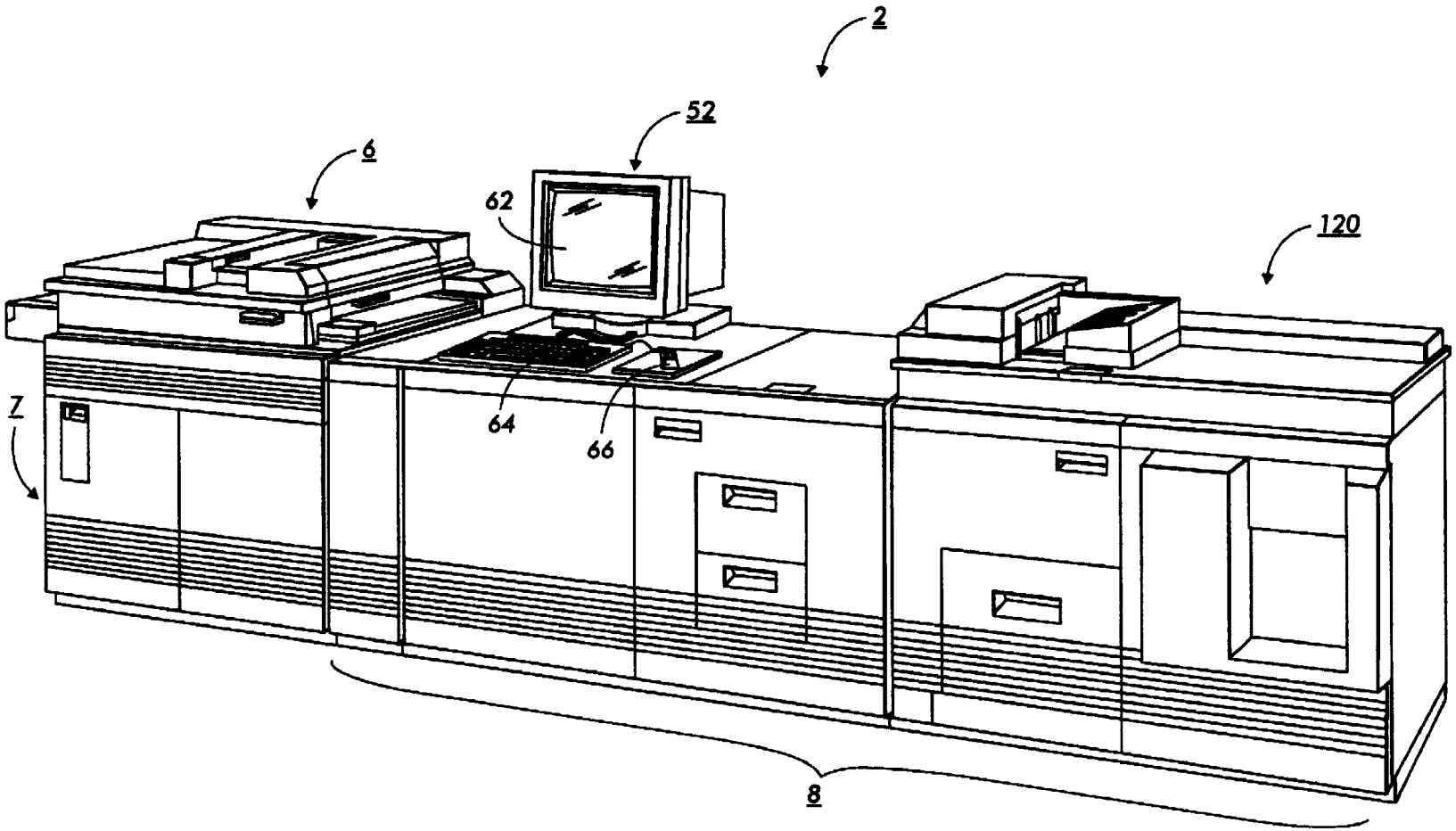
FIG. 1 is a perspective view depicting a printing system.
Figure 2:
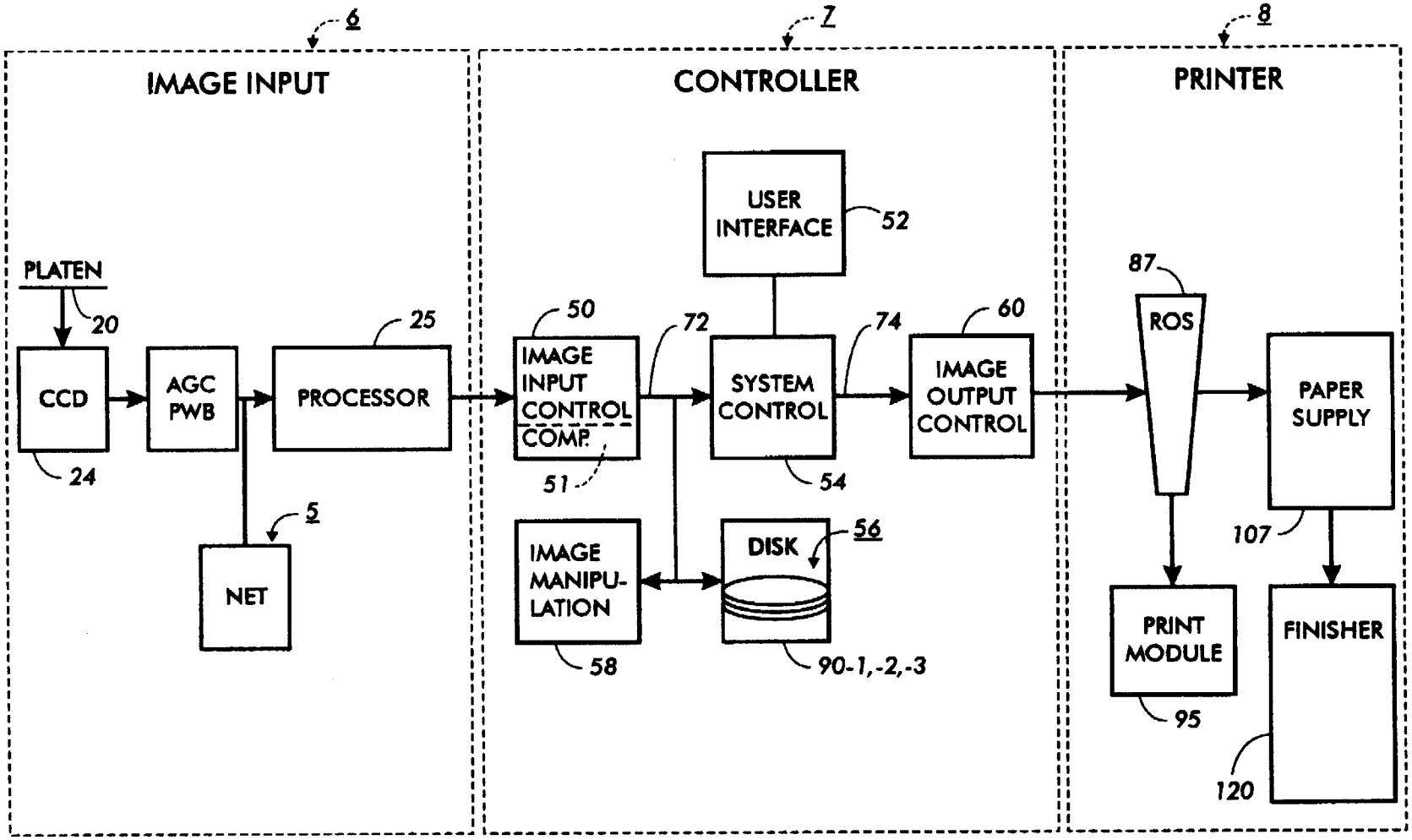
FIG. 2 is a block diagram depicting the major elements of the printing system of FIG. 1.

Referring to FIGS. 1 and 2, there is shown an exemplary laser based printing system (or imaging device) for processing print jobs in accordance with the teachings of the present invention. Printing system 2, for purposes of explanation, is divided into a scanner section 6, controller section 7, and printer section 8. While a specific printing system is shown and described, the present invention may be used with other types of printing systems such as ink jet, ionographic, etc.

For off-site Digital image input, image input section 6 has a network 5 with a suitable communication channel, such as an ethernet or optic fiber connection, enabling image data, in the form of image signals or pixels, from one or more remote sources, to be input to system 2 for processing. Other remote sources of image data, such as streaming tape, floppy disk, video camera, etc. may be envisioned.

Figure 3:
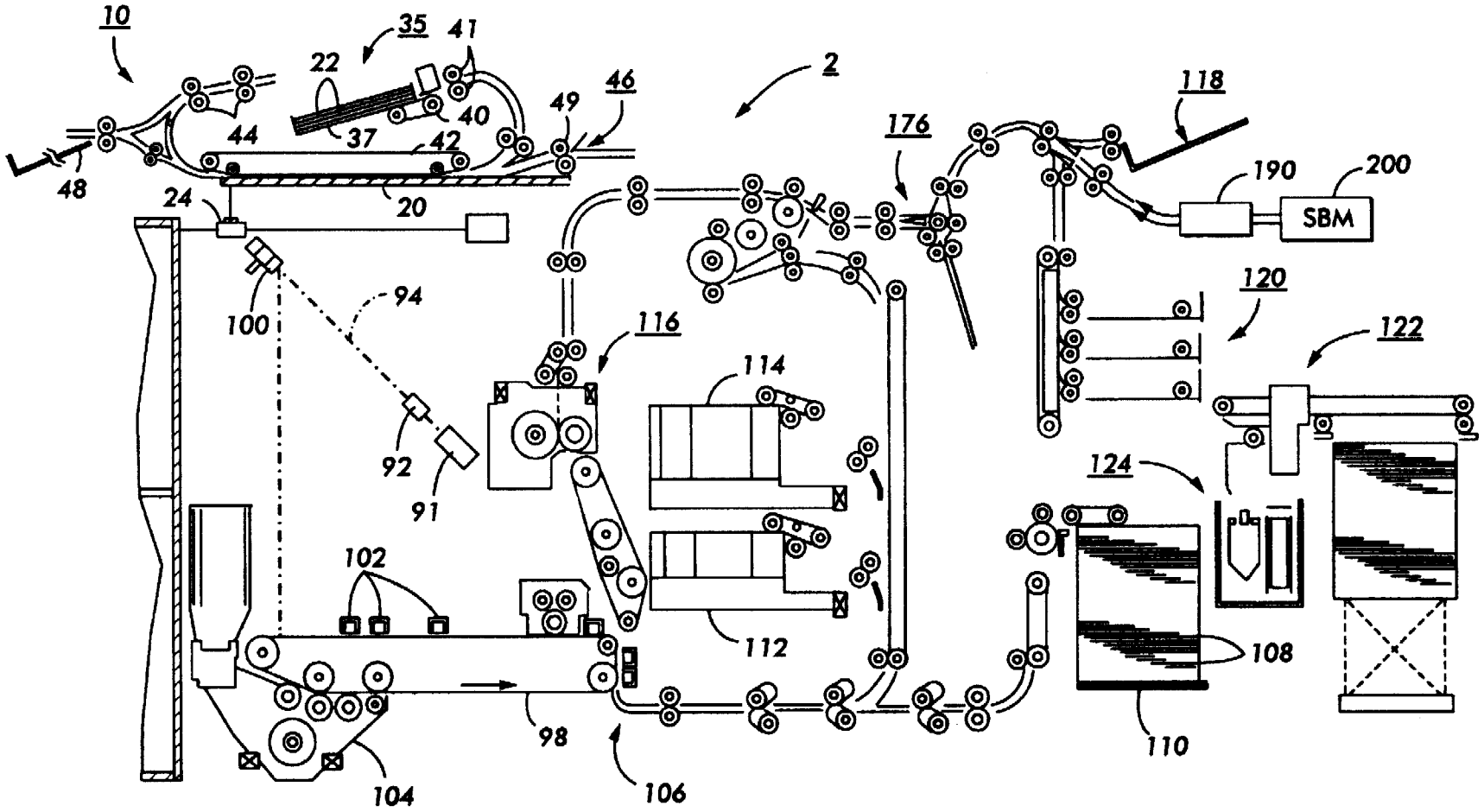
FIG. 3 is an elevational view illustrating the principal mechanical components of the printing system of FIG. 1.

Referring particularly to FIGS. 2 and 3, scanner section 6 incorporates a transparent platen 20 on which the document to be scanned is located. Processor 25 converts the analog image signals output by array 24 to digital image signals and processes the image signals as required to enable system 2 to store and handle the image data in the form required to carry out the job programmed. Processor 25 also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDHL) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stack,(sets) or batches. The documents 22 in tray 37 are advanced by vacuum feed belt 42 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which in turn advances a page of the fanfold material into position on platen 20.

Referring to FIGS. 2 and 3, printer section 8 comprises a (300–1200 pixel Light Emitting Diode Bar) or laser type printer and, for purposes of explanation is separated into a Raster Output Scanner (ROS) section 87, Print Module. Section 95, Paper Supply Section 107, and High Speed Finisher 120. ROS 87 has a laser 90, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, to high speed finisher 120, or through bypass 180 to some other downstream finishing device, which could be a low speed finishing device such as a signature booklet maker (SBMO) 200 of the type manufactured by Bourg AB. High speed finisher 120 includes a stitcher 122 for stitching or stapling the prints together to form books and thermal binder 124 for adhesively binding the prints into books.

Referring still to FIG. 3, the SMB 200 is coupled with the printing system 2, by way of a bypass 180, for receiving printed signatures. A sheet rotary 190 is positioned at an input of the SBM and the SBM includes three stations, namely a stitching station, a folding station and a trimming station, in which a plurality of signatures are processed. In operation, the signatures are transported through the bypass 180 to the sheet rotary 190 where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature and function of the SBM 200 can be obtained by reference to U.S. Pat. No. 5,159,395 to Farrell et al.

Figure 4:
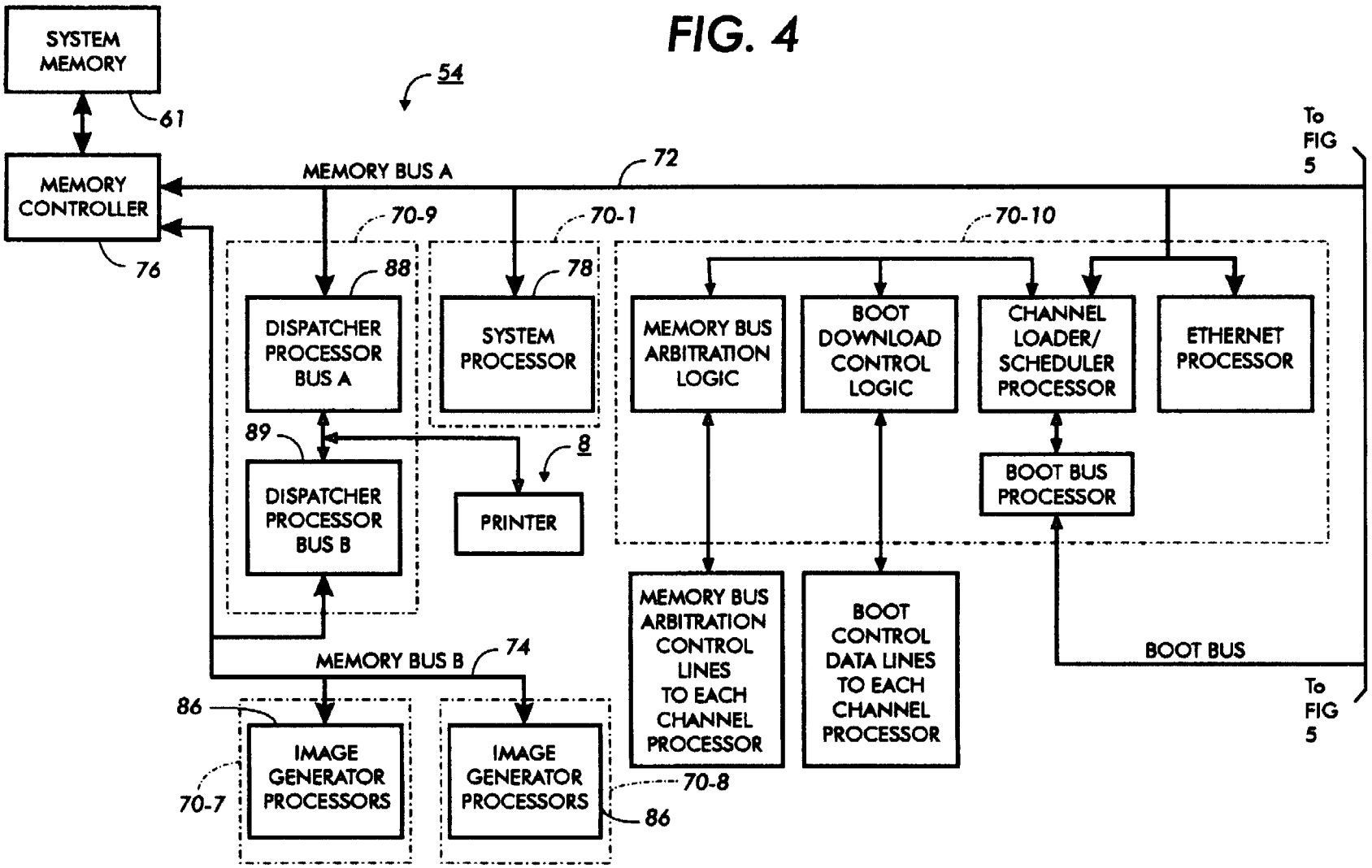
FIGS. 4–6 comprise a schematic block diagram showing the major parts of a control section of the printing system of FIG. 1.

Referring to FIGS. 1, 2 and 4 controller section 7 is for explanation purposes, divided into an image input controller 50, User Interface (UT) 52, system controller 54, main memory 56, image manipulation section 58, and image output controller 60.

The scanned image data input for processor 25 of scanner section 6 to controller section 7 is compressed by image compressor/processor 51 of image output input controller 50 on PWB 70-3. As the image data passes through compressor/processor 51, is segmented into N scanlines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending a transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions to obtain system operating information, instructions, programming information, diagnostic information, etc. Items displayed on touchscreen 62 such as files and icons are actuated by either touching the displayed item on screen 62 with a finger or by using mouse 66 to point a cursor to the item selected and keying the mouse.

Main memory 56 has plural hard disks 90-1, 90-2, 90-3 for storing machine Operating System software, machine operating data, and the scanned image data currently being processed. When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent to image output controller 60.

Image data output to image output controller 60 decompressed is and readied for printing by image generating processors 86 of PWBs 70-7, 70-8 (seen in FIG. 5A). Following this, the data is output by dispatch processors 88, 89 on PWB 70-9 to printer section 8. Image data sent to printer section 8 for printing is normally purged from memory 56 to make room for new image data.

Figure 5:
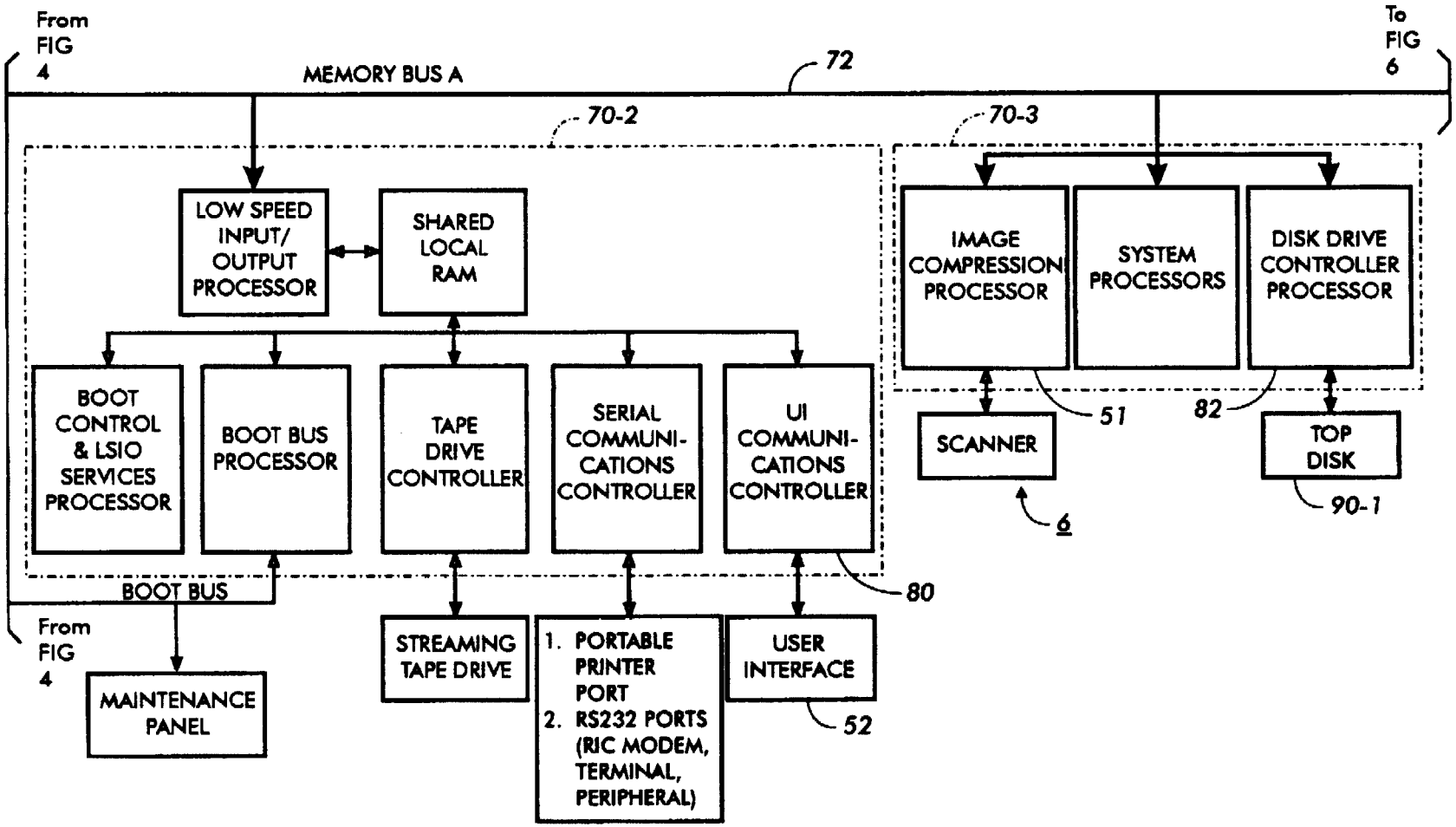
Figure 6:
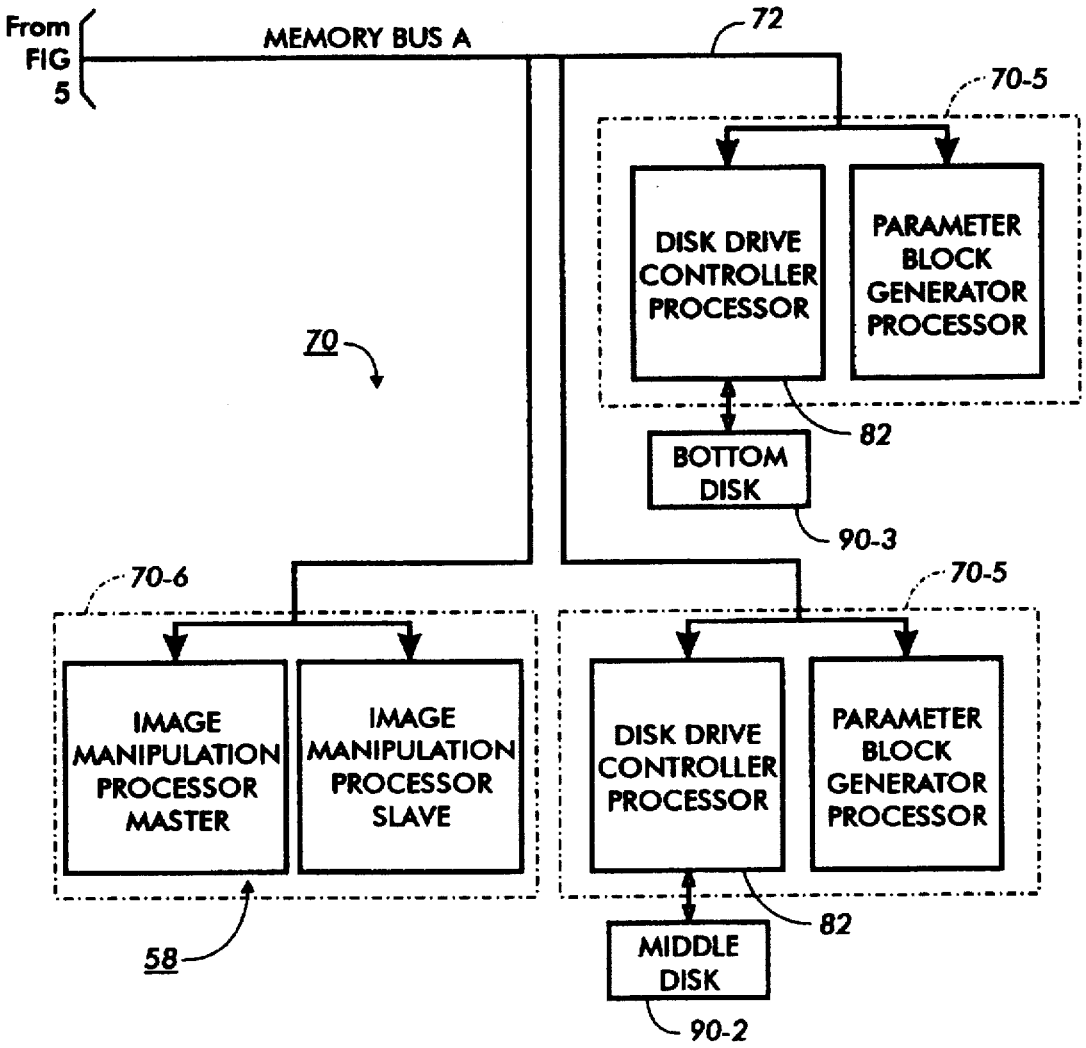

Referring particularly to FIGS. 4–6 control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs include system processor PWB 70-1 having plural system processors 78; low speed I/O processor PWB 70-2 having UI communication controller 80 for transmitting data to and from UI 52; PWBs 70-3, 70-4, 70-5 having disk drive controller/processors 82 for transmitting data to and from disks 90-1. 90-2, 90-3 respectively of main memory 56 (image 60 compressor/processor 51 for compressing the image data is on PWB 70-3); image manipulation PWB 706 with image manipulation processors of image manipulation section 58; image generation processor PWBs 70-7, 70-8 with image generation processors 86 for processing the image data for printing by printing section 8; dispatch processor PWB 70-9 having dispatch processors 88, 89 for controlling transmission of data to and from printer section 8, and boot control-arbitration scheduler PWB 70-10.

Figure 7:
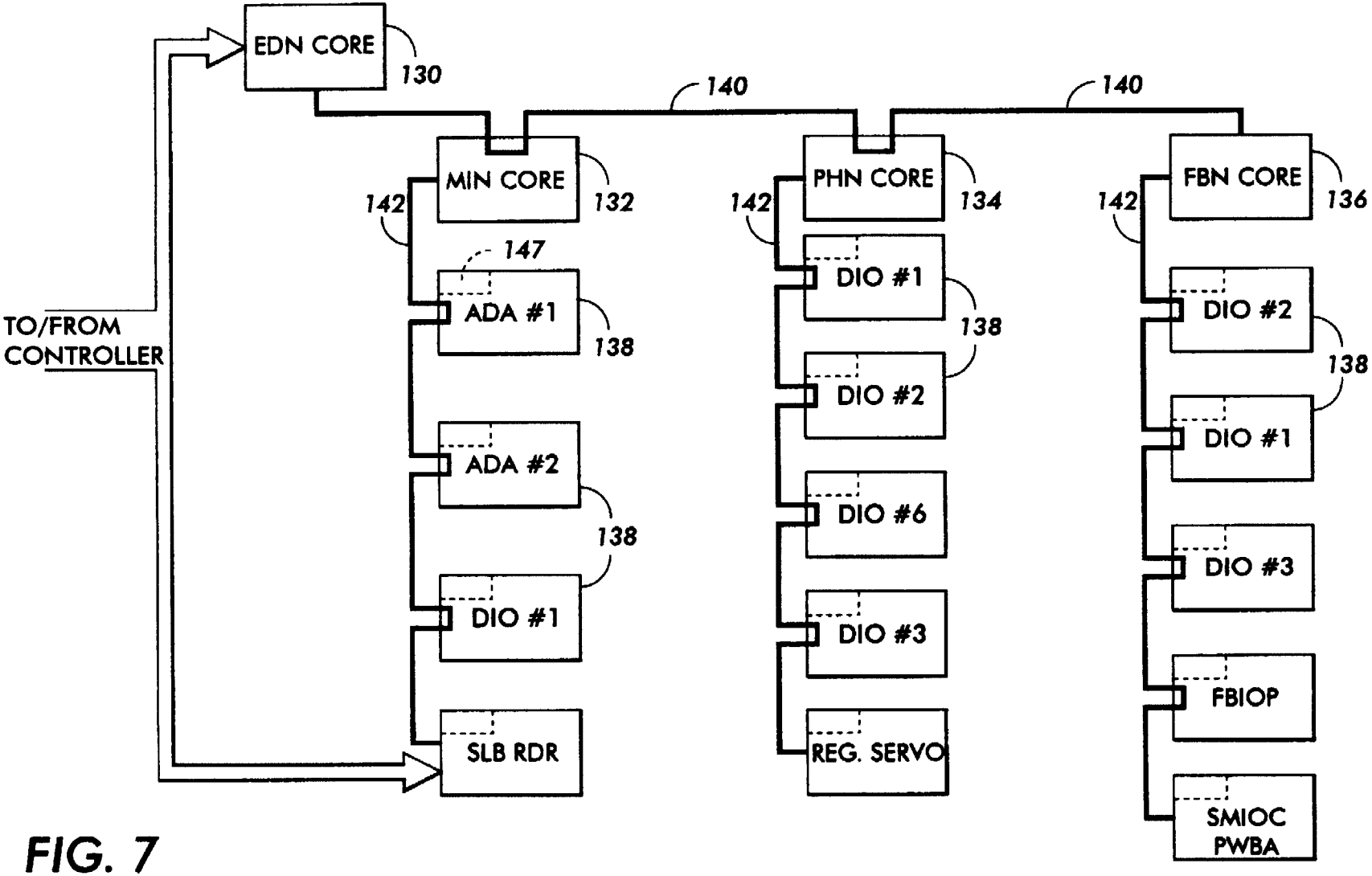
FIG. 7 is a block diagram of the Operating System together with printed wiring boards and shared line connections for the printing system of FIG. 1.

Referring particularly to FIG. 7, system control signals are distributed via a plurality of printed wiring boards (PWBs). These include EDN (electronic data node) core PWB 130, Marking Imaging core PWB, 132, Paper Handling core PWB 134*m* and Finisher Binder core PWB 136 together with various Input/output (I/O) PWBs 138. A system bus 140 couples the core PWBs 130,132, 134, 136 with each other and with controller section 7 while local buses 142 serve to couple the I/O PWBs 138 with each other and with their associated core PWB.

A Stepper Motor Input Controller (SMIOC) Printed Wiring Board Assembly (PEBA) is included when the printing system is used with an SBM. The SMIOC PWBA controls the operation of a sheet rotator which may be required when using the SBM. The SMIOC {WBA also handles the exporting of control signals from the printer to the SBM and monitors the status lines from the SBM. The SBM has two status lines whose status is either high or low. The status lines respectively indicate whether the SBM is ready and whether the SBM (output stacking tray) is full.

On machine power up, the Operating System software is loaded from memory 56 to EDN core PWB 130 and from there to remaining core PWBs 132, 134, 136 via bus 140, each core PWB 130, 132, 134. 136 having a boot ROM 147 for controlling downloading of Operating System software to PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

Figure 8:
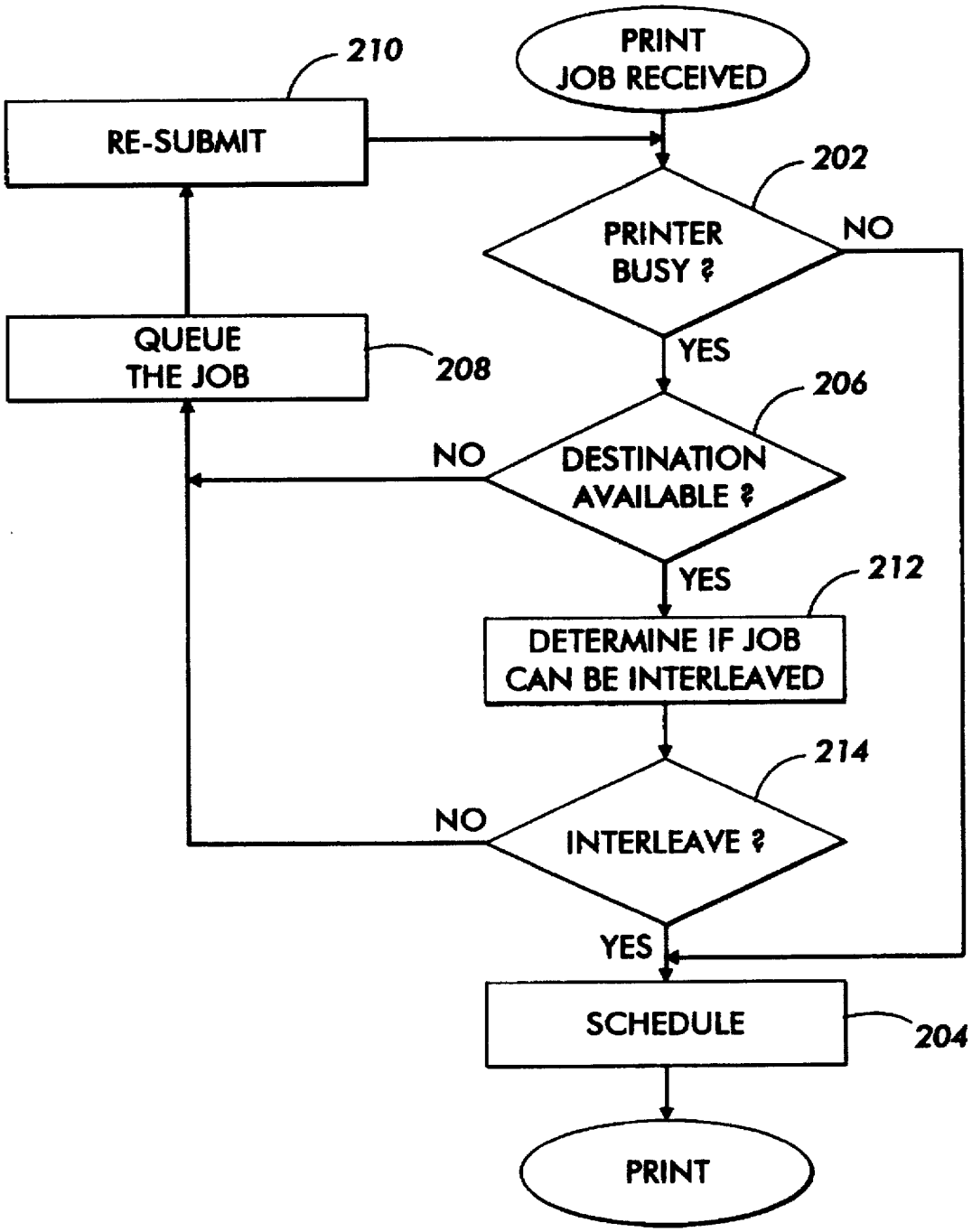
FIG. 8 is a flow chart illustrating a first embodiment of job intermixing in accordance with the present invention.

With reference to FIG. 8, there is shown one scenario for job interleaving in accordance with the present invention. Once a print job is received, either locally over a network, there is a determination whether or not the printer is busy as illustrated at decision block 202. If the printer is not busy, then the particular print job received, can be immediately scheduled for printing as shown by block 204. On the other hand if the printer is busy, a possibility for interleaving the received job with a job currently being printed is then possible. Since the current job is being delivered to a first destination such as a given output or a given finishing station, to be able to interleave the print job just received, it is necessary to determine if there is an alternate destination or finishing station available as illustrated at decision block 206. If there is no alternative output tray or finishing station available, then the job can not be interleaved and must be queued as shown at block 208 and resubmitted for printing as shown in block 210. On the other hand, if there is an alternate destination available, then there is a determination if the job can be interleaved as illustrated at block 212.

It should be understood that block 212 can represent several determinations that may be necessary before a job can be interleaved. For example, there must be a determination if a copy sheet source with suitable copy sheets (for example relating to size) is available to complete the print job just received. Other considerations might be such features as specially required cover sheets or separator sheets and special magnification or quality selections. It should be understood that the intent of the present invention is to interleave a smaller second job within a larger first job by merely selectively interleaving the second job pages amongst the first job pages in a manner not to effect the throughput or productivity of completion of the first job. However, it is well within the scope of the present invention to accommodate more complex interleavings of the second job within the first job depending upon the priority of completion of the first job as well as the priority of jobs in the queue If it is determined that the print job received can be interleaved as illustrated at block 214, the print job received is then scheduled as shown in block 204. If the print job received can not be interleaved depending upon various factors such as discussed above, then the print job received will again join the queue of jobs illustrated at block 208 to be resubmitted as shown at block 210. It should also be understood that the scope of the present invention includes the interleaving of a third job during the processing of the first job either after the completion of the second job that has been interleaved or allowing the third job to be interleaved along with the second job during the processing of the first job.

Figure 9:
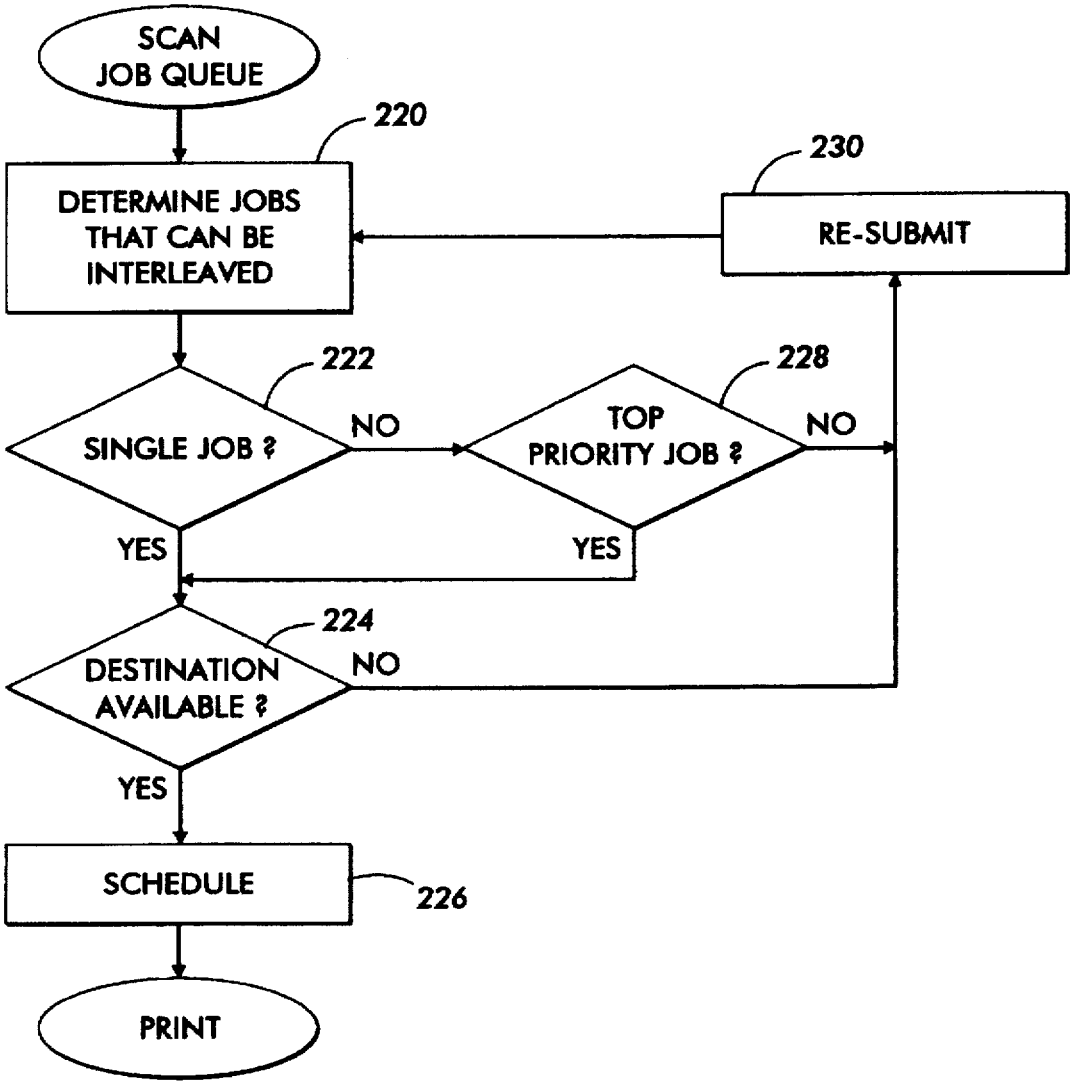
FIG. 9 is a flow chart illustrating a second embodiment of job intermixing in accordance with the present invention.

FIG. 9, illustrates another scenario for interleaving jobs in accordance with the present invention. A job queue is scanned and the determination is made that there are jobs, one or many, that can be interleaved with a current job being printed. A determination that a jobs can be interleaved as contemplated within block 220, is similar to the considerations shown in FIG. 8, block 212. If the job queue includes only a single job that can be interleaved as illustrated in decision block 222, and a determination is made that a destination for the single job to be interleaved is available as shown in block 224, then the job to be interleaved is scheduled as shown in block 226. On the other hand, if there are multiple jobs that can be interleaved, in a preferred embodiment, the top priority job is scheduled for interleaving first.

Various levels of priority of jobs are contemplated within the scope of the present invention such as the immediacy of the required job, the status of the submitting party, or the availability of other resources to accomplish a queued job. Various methods such as code indicators can be used to place a given job in the job queue at a given level of priority. Decision block 228 illustrates a determination and decision as to which is the top priority job in a queue of multiple jobs that are candidates for interleaving with a current job in processing. The jobs in the queue can be scanned to determine priority, and if a job is not a top priority job or the highest priority in the queue of jobs, then as illustrated by block 230 it is resubmitted as a candidate for interleaving. On the other hand, once the highest top priority job is determined, at decision block 228, there is a determination as to whether or not there is an available destination as shown in block 224. If there is an available destination, then the top priority job is scheduled for printing as shown in block 226.

If no destination is available, then the job must be resubmitted as shown at block 230 as a candidate for a job that can be interleaved as illustrated in block 220. It should also be understood that once the top priority job is determined as shown at block 226, the next highest priority job can also be scheduled for interleaving as long as there are suitable destinations available for the third job. It should also be understood that the rate of scheduling an interleave job can be dependent upon the relative priorities of the jobs being interleaved as well as dependent upon the nature of the job currently being printed. For example, a job to be interleaved can be processed at the rate of one page for each page of the job currently being processed, one page for every five pages of the job currently being processed, one page for every ten pages of the job currently being processed, two pages for every one page of the job being currently processed, or any other frequency suitable to the priorities and conditions of the job in process as well as the other jobs in the job queue available to be interleaved.

While the embodiment disclosed herein is preferred, it will be appreciated from this teaching that various alternative, modifications, variations or improvements therein may be made by those skilled in the art, which are intended to be encompassed by the following claims:

We claim:

1. An electronic image processing apparatus comprising a marking machine, a controller, a source of copy sheets, the marking machine providing images on the copy sheets, and multiple output stations to receive copy sheets, the marking machine providing copy sheets to a first output station for a first job, a method of arbitrarily interleaving the images of a second job with the images of a first job during the first job production run comprising the steps of:

determining if another output station is available, scanning a queue of jobs submitted to the marking machine for completion, each of the jobs submitted to the marking machine for completion having a priority status, deciding that at least one of the queue of jobs can be interleaved during the first job production run to be completed at said another output station prior to the completion of said first job, including the step of determining the rate of interleave of said at least one of the queues of jobs, and scheduling said at least one of the queue of jobs to be interleaved during the first job production run for completion at said another output station.

2. The method of claim 1 including the steps of determining that multiple output stations are available and scheduling multiple jobs from the queue of jobs to be interleaved during the first job production run for completion at multiple output stations.

3. The method of claim 1 wherein the step of scheduling includes the step of interleaving pages of said at least one of the queue of jobs in an arbitrary manner with the pages of the first job production run.

4. The method of claim 3 wherein the step of interleaving includes the step of interleaving images provided by the marking machine on a photoreceptor surface.

5. The method of claim 3 wherein the step of interleaving includes the step of interleaving copy sheets provided by the marking machine prior to conveyance to output stations.

6. The method of claim 3 wherein the step of interleaving pages of said at least one of the queue of jobs in an arbitrary manner with the pages of the first job production run includes the step of processing images of said at least one of the queue of jobs in a given ratio to the processing of images of said first job.

7. The method of claim 1 wherein the step of deciding that at least one of the queue of jobs can be interleaved during the first job production run includes the step of determining that multiple jobs in the queue can be interleaved during the first job production run.

8. The method of claim 7 wherein the step of determining that multiple jobs in the queue can be interleaved during the first job production run includes the step of determining the rate of interleave of said multiple jobs.

9. The method of claim 8 wherein the rate of interleave of each of said multiple jobs is different.

10. An electronic image processing apparatus comprising a marking machine, a controller, a source of copy sheets, the marking machine providing images on the copy sheets, and multiple output stations to receive copy sheets, the marking machine providing copy sheets to a first output station for a first job, a method of arbitrarily interleaving the images of a second job with the images of a first job during the first job production run comprising the steps of:

determining if another output station is available, scanning a queue of jobs submitted to the marking machine for completion, each of the jobs submitted to the marking machine for completion having a priority status, deciding that at least one of the queue of jobs can be interleaved during the first job production run to be completed at said another output station prior to the completion of said first job, and interleaving portions of said at least one of the queue of jobs in an arbitrary manner with portions of the first job production run including the step of processing images of said at least one of the queue of jobs in a given ratio to the processing of images of said first job.

11. The method of claim 10 including the steps of determining that multiple output stations are available and scheduling multiple jobs from the queue of jobs to be interleaved during the first job production run for completion at multiple output stations.

12. The method of claim 10 wherein the step of interleaving pages of said at least one of the queue of jobs in an arbitrary manner with the pages of the first job production run includes the step of processing images of said at least one of the queue of jobs in a given ratio to the processing of images of said first job.

13. The method of claim 10 wherein the step of deciding that at least one of the queue of jobs can be interleaved during the first job production run includes the step of determining that multiple jobs in the queue can be interleaved during the first job production run.

14. The method of claim 10 wherein the step of deciding that at least one of the queue of jobs can be interleaved during the first job production run includes the step of determining the rate of interleave of said at least one of the queue of jobs.

15. The method of claim 10 wherein the step of determining that multiple jobs in the queue can be interleaved during the first job production run includes the step of determining the rate of interleave of said multiple jobs.

16. The method of claim 15 wherein the rate of interleave of each of said multiple jobs is different.

* * * * *